US007281593B2

(12) United States Patent
Steiner et al.

(10) Patent No.: US 7,281,593 B2
(45) Date of Patent: Oct. 16, 2007

(54) METHOD FOR THE CIRCULATION OF GAS WHEN DRILLING OR WORKING A WELL

(75) Inventors: Adrian Steiner, Calgary (CA); Richard Allan McAlary, Alberta (CA); Ross Michael Krill, Red Deer (CA)

(73) Assignee: Precision Energy Services, Ltd., Alberta (CA)

( * ) Notice: Subject to any disclaimer, the term of this patent is extended or adjusted under 35 U.S.C. 154(b) by 257 days.

(21) Appl. No.: 11/081,605

(22) Filed: Mar. 17, 2005

(65) Prior Publication Data

US 2006/0124300 A1 Jun. 15, 2006

(30) Foreign Application Priority Data

Dec. 10, 2004 (CA) ..... 2489968

(51) Int. Cl.
*E21B 21/16* (2006.01)

(52) U.S. Cl. ..... 175/71; 175/212; 175/218; 166/90.1; 166/75.12

(58) Field of Classification Search ..... 175/69, 175/71, 206, 218, 212; 166/75.12, 75.11, 166/90.1, 369, 267
See application file for complete search history.

(56) References Cited

U.S. PATENT DOCUMENTS 5,775,442 A 7/1998 Speed
6,206,113 B1 3/2001 Michael

*Primary Examiner*—Kenneth Thompson
*Assistant Examiner*—Giovanna M Collins
(74) *Attorney, Agent, or Firm*—Merek, Blackman & Voorhees, LLC

(57) ABSTRACT

A method for the circulation of gas when drilling or working a well. The method includes the step of pressurizing at least two chambers of a multi-chambered accumulator with inert gas. The chambers of the multi-chambered accumulator are operatively connected to one another and individually or in combination isolatable from each other. The method also includes isolating at least one chamber of the accumulator that has been pressurized with inert gas such that during drilling or working the well the isolated chamber remains pressurized with gas that has not been mixed with well gas returns. Pressurized gas is extracted from one or more of the non-isolated chambers of the accumulator and injected into the well. At least a portion of the gas returns from the well is collected, compressed and delivered to at least one of the non-isolated chambers of the multi-chamber accumulator.

25 Claims, 5 Drawing Sheets

METHOD FOR THE CIRCULATION OF GAS WHEN DRILLING OR WORKING A WELL

FIELD OF THE INVENTION

This invention relates generally to a method for circulating gas within a well when the well is undergoing drilling or other working operations. In one particular embodiment the invention relates to a method for the circulation of gas when drilling a well in an underbalanced state.

BACKGROUND OF THE INVENTION

Traditionally wells drilled deep into the earth, and in particular wells driven into underground hydrocarbon formations for purposes of extracting oil and gas, have been drilled through circulating a drilling fluid or mud downwardly through a drill string to the bottom of the well and then subsequently up the annulus between the string and the well casing. The drilling fluid serves the primary purposes of exerting hydrostatic pressure upon the underground formation in an attempt to prevent the entry of hydrocarbons or other native fluids into the wellbore and provides a means by which rock cuttings and other debris may be carried upwardly and expelled from the well. In situations where the well is being drilled through the use of a downhole motor, the circulating mud or fluid also serves as a means of energizing, cooling and lubricating the downhole motor.

When drilling deep wells, or wells through formations containing highly pressurized fluids, commonly a high density drilling mud is used in order to obtain a sufficient hydrostatic pressure (overbalanced) at the bottom of the well to prevent the influx of fluids into the wellbore and to maintain well control. Unfortunately, with the added level of control and enhanced level of safety that may be achieved through the use of a heavy, high density, drilling mud there also comes the drawback that the mud may be forced into or penetrate the hydrocarbon zone, particularly where such zones exist in porous, fractured or permeable formations. The loss or penetration of drilling mud into the underground formation not only affects the economics of the drilling operation through the need to use greater volumes of mud (which in some instances may contain expensive density enhancing materials), but can also affect the productivity of the well after the drilling operations have ceased. That is, the penetration of drilling mud into the hydrocarbon formation can damage the underground formation and later impede the flow of hydrocarbons into the well during the production phase.

In an effort to avoid the problems associated with overbalanced drilling, others have utilized a drilling method where a low density or light drilling fluid or mud is circulated through the well creating a bottom hole pressure that is generally below that of the underground hydrocarbon formation so that drilling fluid does not penetrate the formation. This method is known generally as underbalanced drilling but is sometimes also referred to as controlled pressure drilling or managed pressure drilling, and may include foam drilling, flow drilling and gas or dust drilling. When drilling underbalanced, the drilling fluid (which may be water, diesel fuel, or a variety of other low density fluids) is typically "lightened" with an added gas and used as the circulating medium upon entry into the underground hydrocarbon formation. Most commonly the gas used to lighten the drilling fluid is nitrogen due to its availability, cost, and the fact that it is inert. Other gases may also be used, depending upon their availability and cost. In most instances the gas will be added to the drilling fluid at the surface but in some instances it may be introduced at the base of the drill string or at a casing/casing or liner/casing transition point through the use of a parasite string or a concentric casing. Where the service gas is nitrogen it is typically derived from a cryogenic source or generated on site by means of an exhaust gas or membrane generation system. In some instances natural gas may be used in place of nitrogen, however, there will still exist the necessity for an inert gas for purging purposes, such as when making a connection and before tripping pipe out of the hole.

As the drilling fluid is circulated through a well during underbalanced drilling, the well returns at the surface will typically comprise the initial drilling fluid (which as indicated may be water, diesel fuel or other fluid), rock cuttings, and the gas that was added to lighten or reduce the fluid's density. Where the well is drilled through an underground hydrocarbon formation, the drilling returns may also include oil and/or gaseous hydrocarbons. In such situations the well returns are typically passed through a separation vessel to separate the solid, liquid and gas phases. The separated gases are commonly vented or flared. Alternatively, and as suggested in U.S. Pat. No. 5,775,442, the separated gases may be recycled back to the drill pipe.

Where the separated drilling returns contain natural gas, flaring is often not an attractive option on the account of environmental concerns and the reluctance to waste a valuable resource. Where natural gas pipelines are within close proximity the separated gas can be sent to a compression stage and injected into the gas pipeline presenting a potential source of revenue. While such prior systems may be advantageous from the perspective of avoiding having to send gas to flare, they still require the use of relatively extensive compression equipment that adds both to the capital and operating costs of the project. In addition, regardless of the level of recycling or injection of natural gas into the well, service gas will still be required during start up of the operation. An inert gas source must also be available for purging. It has therefore been historically necessary to have a standard inert or service gas system readily available at the drill site. Such inert gas systems are often capital intensive and require significant amounts of energy to generate the volumes of inert gas that are required for start up and for drilling purposes.

SUMMARY OF THE INVENTION

The invention therefore provides a method for the circulation of gas in a well that permits the use of a reduced size inert gas system in conjunction with a multi-compartment or multi-chamber accumulator or gas storage device that helps to address some of the deficiencies in the prior art.

Accordingly, in one of its aspects the invention provides a method for the circulation of gas when drilling or working a well, the method comprising pressurizing at least two chambers of a multi-chambered accumulator with inert gas, said chambers of said multi-chambered accumulator operatively connected to one another and individually or in combination isolatable from each other; isolating at least one chamber of said accumulator that has been pressurized with inert gas such that during drilling or working the well said isolated chamber remains pressurized with gas that has not been mixed with well gas returns; extracting pressurized gas from one or more of the non-isolated chambers of said accumulator and injecting said pressurized gas into the well; and, collecting and compressing at least a portion of the gas returns from the well and delivering said pressurized returns to at least one of the non-isolated chambers of said multi-chamber accumulator.

In a further aspect the invention provides a method for the circulation of gas when drilling or working a well, the method comprising pressurizing at least two chambers of a multi-chambered accumulator with inert gas from an inert gas generating system, said chambers of said multi-chambered accumulator connected to one another by a piping system and individually or in combination isolatable from each other through the use of one or more valves; operating said one or more valves to isolate one of the chambers of said accumulator that is pressurized with inert gas; extracting pressurized inert gas from the non-isolated chambers of said accumulator and injecting said pressurized inert gas into the well; collecting and compressing at least a portion of the gas returns from the well and delivering said pressurized returns to the non-isolated chambers of said multi-chamber accumulator such that thereafter gas injected into the well comprises gas returns from the well and the contents of the non-isolated chambers of said accumulator.

In yet a further aspect the invention concerns a method for the circulation of gas in a well when drilling or working the well, the method comprising pressurizing two or more chambers of a multi-chambered accumulator with inert gas from an inert gas system, said chambers of said multi-chambered accumulator operatively connected together and isolatable from one another either individually or in combination; upon the pressurization of said two or more chambers with said inert gas, isolating at least one chamber from the others and extracting pressurized inert gas from the non-isolated chambers and injecting said extracted pressurized gas into the well; controlling the rate of injection of gas into the well through the use of a flow controller; and, collecting and compressing at least a portion of the gas returns from the well and delivering said pressurized returns to said non-isolated chambers of said accumulator.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show some of the preferred embodiments of the present invention in which.

DESCRIPTION OF THE PREFERRED EMBODIMENT

Figure 1:
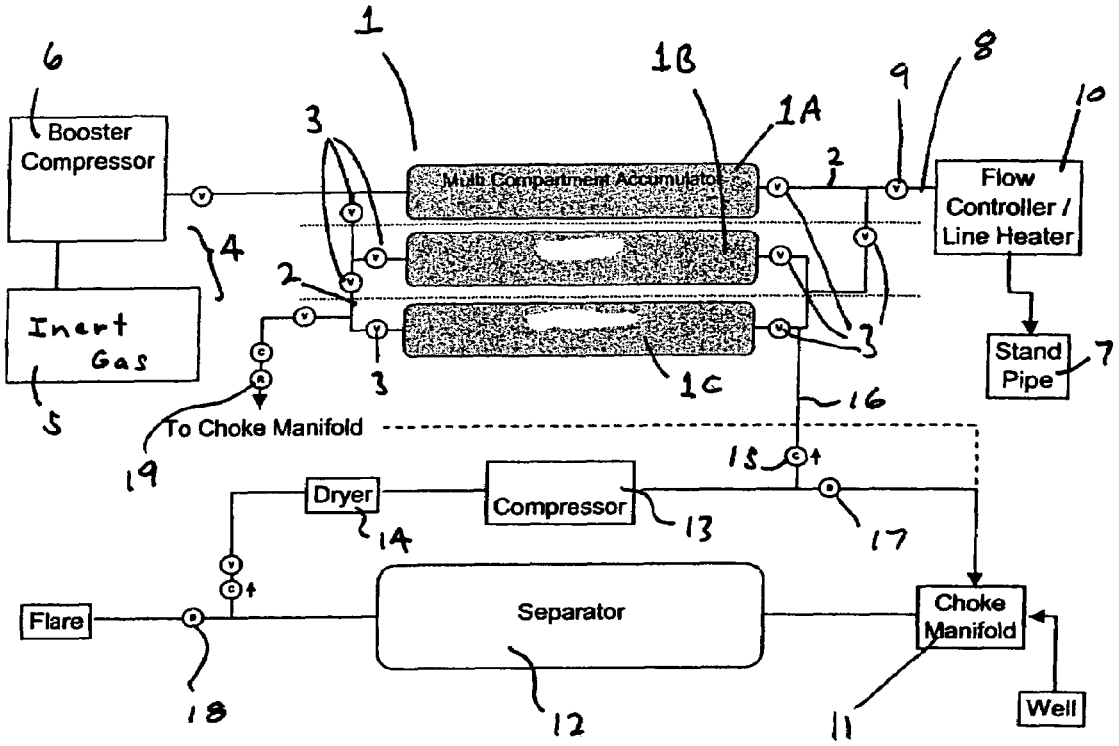
FIG. 1 is a schematic circuit drawing of a preferred embodiment of the present invention wherein the accumulator is undergoing a pre-charge cycle.

The present invention may be embodied in a number of different forms. The specification and drawings that follow describe and disclose only some of the specific forms of the invention and are not intended to limit the scope of the invention as defined in the claims that follow herein.

Integral to the operation of the method of the present invention is the use of a multi-chambered or multi-compartment accumulator that is capable of receiving and storing both pressurized inert gas and gas returns from the well. The accumulator is preferably modular in nature and comprised of two or more separate compartments or chambers that are operatively connected together while at the same time being isolatable from one another. Depending upon the requirements of a particular job site each of the individual compartments or chambers of the accumulator may be isolatable from one another. Alternatively, there may exist the ability to join or link combinations of individual chambers together and to then isolate those combinations of chambers to effectively increase the isolatable volumes beyond that which could be obtained through isolating individual chambers. In the embodiment of the invention that is shown schematically in the attached drawings, the accumulator (noted generally by reference numeral 1) is comprised of three separate chambers (1A, 1B and 1C, respectively) that are connected to one another by means of a piping system 2. A series of isolation valves 3 are positioned within piping 2 to enable the individual chambers to be isolated from one another or to be linked in any combination. It should be noted that other means of both connecting the individual chambers together and of isolating the chambers, beyond the described piping and valve structure, could be used without departing from the invention.

While the physical configuration of accumulator 1 may vary, typically the accumulator will be similar to a traditional "tube trailer" (that may contain one or more banks of tubes) that provides for an efficient pressure vessel design (ie generally small in diameter relative to its length) to enable the accumulator to withstand pressures typically ranging from approximately 2500 pounds per square inch (17.2 MPa) to 5000 pounds per square inch (34.5 MPa). The precise pressure rating requirements for a particular accumulator will of course be to a large extent dependent upon the operating pressures that it will be subjected to at particular well sites. The accumulator may be formed from steel, aluminum, composites or any variety of other materials that are commonly used to manufacture pressure vessels. The accumulator may also be exposed to the environment or enclosed within a heated compartment.

Accumulator 1 may be permanently mounted to the ground at a drilling or well site or it may be positioned on skids or on a series of flatbed trailers. Depending upon the requirements of a particular operation the volume of the accumulator necessary at any specific job site may vary, however, it is expected that in most instances the accumulator volume will typically be in excess of 2000 standard cubic meters of gas. From a thorough understanding of the invention it will be appreciated that where an accumulator having an increased volume is required additional compartments may be added by connecting one or more further pressure vessels to the accumulator until the required volume has been met.

In accordance with the method of the present invention at least one of the chambers of accumulator 1 is pressurized with inert gas from an inert gas generating system (identified generally in the attached figures by reference numeral 4). While a variety of different inert gases could be used, in most cases the gas of choice will be nitrogen on account of the ability to generate nitrogen on-site at a relatively modest cost. Accordingly, in most cases inert gas generating system 4 will be comprised of a nitrogen generator 5 that feeds a booster compressor 6, which in turn directs pressurized nitrogen into at least one chamber of accumulator 1. Nitrogen generator 5 may comprise a unit that generates a stream of cryogenic nitrogen (or that vaporizes cryogenic nitrogen stored on location and generated off site), an exhaust gas system, a membrane nitrogen generator or a pressure swing adsorption unit.

For reasons that will become apparent, the employment of the method described herein permits the use of a relatively low rate inert gas generating unit when compared to conventional drilling or working methods that often require substantially larger units, representing in potential cost savings. For example, when engaged in a drilling operation under the present invention it has been determined that an inert gas or nitrogen generation unit producing at a rate of 5 to 10 standard cubic meters per minute may be used to replace a more conventional inert gas unit that typically produces approximately 40 standard cubic meters per minute. It will, however, be understood that the service requirements for a particular well will be determined based upon parameters such as expected well inflow, injection rates required (liquid and gas rates), the design volume of the accumulator, etc. The actual reduction in the size of the service gas unit that may be achieved through use of the present invention may therefore vary from job site to job site. The invention also presents the opportunity to operate a standard service gas unit intermittently, or to use a single service gas unit to provide gas for mobile storage for servicing a number of sites, providing further operational costs savings.

In an alternate embodiment the mobility of the accumulator provides the possibility for the use of a remote inert gas generation system to pressurize the accumulator before the accumulator is delivered to the well or drilling site. The accumulator could then be recharged as necessary at the drill site with a mobile inert gas unit. In a further alternate embodiment, individual chambers of the accumulator could be removed and changed out with fully charged chambers as required, thereby eliminating the need for inert gas generation or re-charging at the well.

As is shown in FIG. 1, the individual chambers of the accumulator are not only operatively connected to one another by means of piping system 2, but are also collectively connected to the standpipe 7 by means of a standpipe feed line 8. A valve 9 is used to interrupt the flow of gas to the standpipe when necessary. Through the operation of isolation valves 3, the contents of any one or any combination of one or more individual chambers of the accumulator may be directed to the standpipe.

Typically a flow controller 10 will be positioned between the accumulator and the standpipe in order to regulate the injection of gas into the well. Flow controller 10 in most instances will consist of a gas flow meter and a flow computer that controls the rate of flow through a choke to the injection line. Depending upon the pressure drop and the associated temperature drop of the gas, a line heater may be incorporated into the structure to prevent the formation of hydrates and to ensure that the injection temperature of the gas is within a suitable operating range when taking into account the equipment being used. For example, in a drilling operation the characteristics of the pipe, the Kelly hose, and any sealing elements in the pipework or valves will in many cases define the preferred temperature range of the injection gas.

Again with reference to FIG. 1, there is depicted in schematic form the general flow path of returns from the well in accordance with one of the preferred embodiments of the invention. During drilling or other similar operations, the returns from the well are commonly directed through a choke manifold 11 and then into a separator 12. The separator may be any one of a variety of commonly used devices that separate the gas, solid and liquid phases of the well returns. Separator 12 may thus be used to separate the gas phase from the well returns and direct the gas to a compressor 13 that pressurizes the gas and recycles it back to charge the accumulator. A dryer 14 may be positioned upstream of the compressor to remove any water vapour that is present.

The charging of the accumulator by return gas from the separator is in the preferred embodiment largely controlled by a backpressure valve 17 that directs gas from the discharge of the compressor back to the separator via the choke manifold 11 as the maximum discharge pressure of the compressor is approached in the accumulator. Alternately, backpressure valve 17 may send the compressor discharge directly back into the separator or to flare, a gas pipeline or a gas recovery device. A check valve 15 may be placed in compressor/accumulator feed line 16 to eliminate the potential of high pressure gas flowing from the accumulator to the compressor. Where an inflow of gas into the well is encountered, backpressure valve 17 will accommodate the handling of the excess volume of gas in the same manner as in the case where the maximum discharge pressure of the compressor is approached in the accumulator. Finally, a further pressure release valve 18 is preferably positioned in the separator exhaust line and set at the maximum pressure for the compressor intake. Alternately, valve 18 can be set at a value higher than the maximum compressor inlet pressure (even as high as the maximum separator operating pressure) as long as the inlet of the compressor is equipped with a regulator. All return gas will thus be recycled to the compressor unless the pressure within the separator discharge exceeds the maximum compressor intake pressure, at which time the excess gas will be sent to flare or, alternately, to a gas export pipeline or gas recovery system.

From an understanding of the physical structure of the components utilized when employing the method of the present invention it will be appreciated that the use of a multi-chambered or multi-compartment accumulator where individual chambers or compartments are connected to one another, and at the same time are individually and/or in combination isolatable from each other, permits either a portion or the entire volume of the accumulator to be initially charged with inert gas. Pressurized gas may then be extracted from the accumulator and injected into the well. At that point individual chambers or compartments of the accumulator can be isolated from one another through the use of isolation valves 3 such that during operation (whether it be drilling or other well intervention/stimulation procedures, including service or drilling rig operations, clean outs, or intervention processes accomplished through the use of coiled tubing devices) only a portion of the accumulator is used for inert gas storage while the other portion contains well gas returns (in general, natural gas and inert gas). Depending upon the particular well and the operation in question, the number of individual chambers or compartments comprising accumulator 1 may be varied and the number of chambers or compartments that are isolated in order to maintain a storage for inert gas may change. For example, where accumulator 1 is comprised of three separate chambers, one chamber may be isolated and designated solely for inert gas storage while the isolation valves connected to the remaining two chambers may be operated to permit the storage of compressed well gases in both chambers.

With reference to FIGS. 1 through 5, for illustrative purposes a more detailed description of the operation of one of the preferred embodiments of the present invention, as used in association with an underbalanced drilling operation, will now be discussed in greater detail. Referring first to FIG. 1, there is shown in schematic form a circuit drawing of an embodiment of the invention where accumulator 1 is undergoing a pre-charge cycle. In this embodiment accumulator 1 is comprised of three separate chambers (1A, 1B and 1C) operatively connected together by means of piping 2 and isolation valves 3. The shading of chambers 1A, 1B and 1C depicts their pressurization with nitrogen gas from inert gas generating system 4. The inert gas generating system in the depicted embodiment may be a nitrogen membrane unit capable of supplying approximately seven standard cubic meters of nitrogen gas per minute. The nitrogen gas would typically be fed to a booster compressor and then used to charge the three accumulator chambers. While the accumulator is being charged the individual chambers are isolated from the flow controller and from the separation/compressor stage with the compressor in an out-of-service or off-line state. With a typical accumulator volume of approximately 2,000 standard cubic meters, the charging time for the accumulator using a relatively low rate inert gas generation unit such as that described above would commonly be in the range of four to eight hours.

Figure 2:
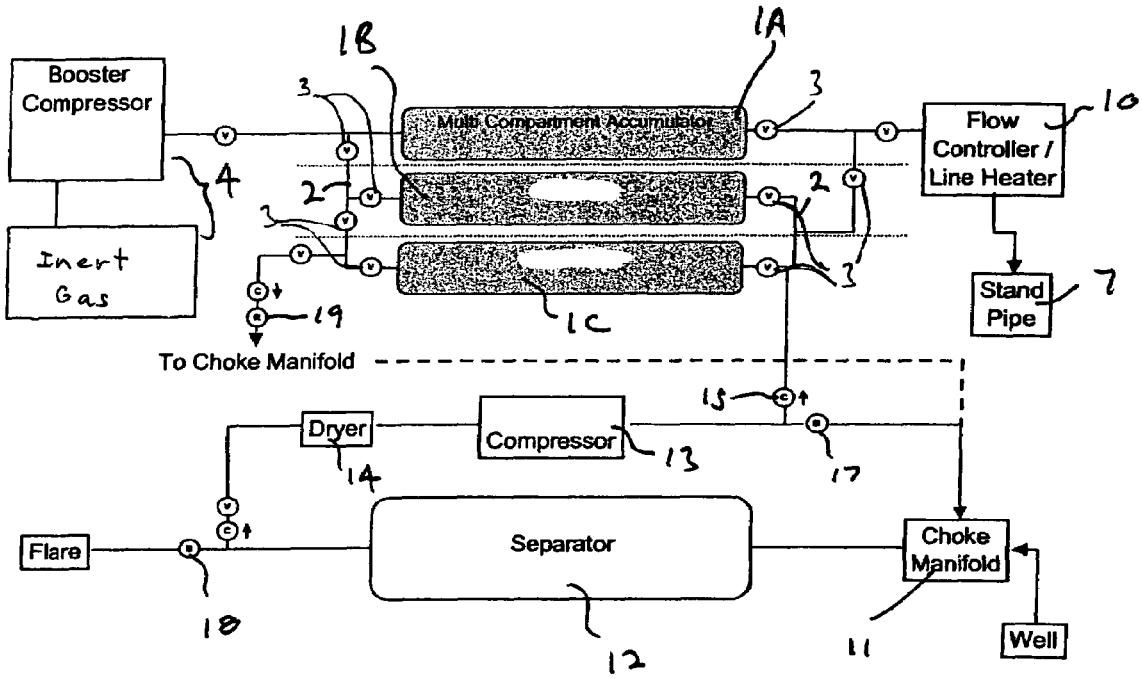
FIG. 2 is a schematic circuit drawing of a preferred embodiment of the present invention wherein the well is undergoing a pre-hole conditioning and a compressor start-up cycle.

Once at least one chamber (and in most cases preferably all chambers) of the accumulator have been pressurized with inert gas the operation can shift from a pre-charge cycle to a pre-hole conditioning and compressor start-up cycle, as indicated generally in FIG. 2. Here isolation valves 3 are operated to isolate chamber 1C so that the continued production of inert gas is directed specifically into chambers 1A and 1B. Gas from chambers 1A and 1B is then diverted to compressor 13 through separator 12 by means of a regulator 19. Gas flowing through the regulator may be diverted directly to the separator inlet or indirectly through the choke manifold. With a feed of inert gas delivered to its intake the compressor may then be started. Backpressure valve 17 will divert compressed gas to the choke manifold 11 as the pressure within compartments 1A and 1B approaches the maximum discharge pressure of the compressor. Once the system is completely charged, excess gas may be diverted to flare by pressure release valve 18. Throughout the pre-hole conditioning and compressor start-up stage the inert gas system is isolated from flow controller 10 with no gas being injected into the well.

Figure 3:
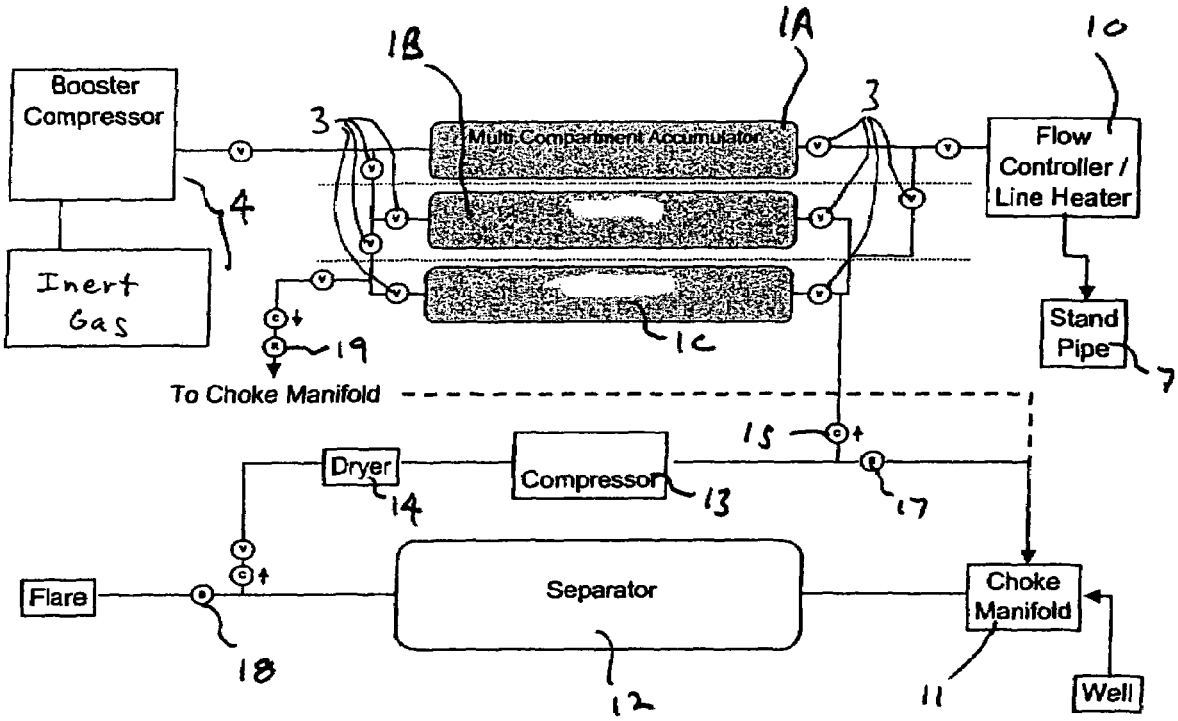
FIG. 3 is a schematic circuit drawing of a preferred embodiment of the present invention wherein the well is undergoing hole conditioning.

The next stage of the operation is shown schematically in FIG. 3 which depicts a hole conditioning phase. Here the inert gas generating system continues to pressurize chambers 1A and 1B. Gas from chambers 1A and 1B is diverted to the compressor through the separator by means of regulator 19. Chamber 1C is isolated from chambers 1A and 1B and acts as a "buffer" between the compressor and the flow controller 10. This stage of the operation allows for the volume of the accumulator in chambers 1A and 1B to be drawn down to the minimum inlet pressure of the compressor. Without the presence of the feedline from the accumulator to the separator, only the volume of gas in chambers 1A and 1B above the standpipe injection pressure could be used for the hole conditioning phase. Thus a much larger accumulator would be required. As an alternative to the process shown in FIGS. 1 through 5, the feedline from the accumulator to the separator could also go directly to the inlet of the compressor rather than to the separator inlet/choke manifold in order to maintain pressure on the compressor (during and/or after start up). As in the case of the injection line that passes through flow controller 10, the feedline to the compressor or separator may also pass through a line heater, possibly including multiple pressure drop/heating cycles to heat the gas before entering the separator or compressor inlet.

Figure 4:
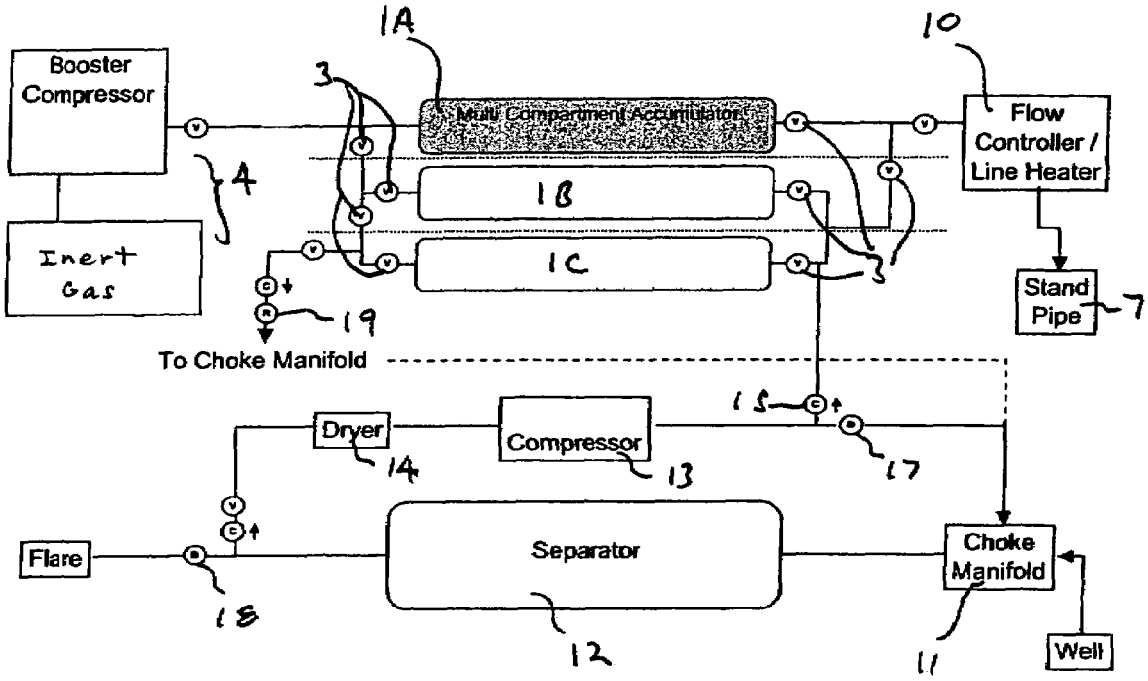
FIG. 4 is a schematic circuit drawing of a preferred embodiment of the present invention wherein the well is undergoing steady state drilling; and, FIG. 5 is a schematic circuit drawing of a preferred embodiment of the present invention wherein the well is undergoing a purging operation.

FIG. 4 represents a schematic circuit drawing of the system during steady state underbalanced drilling. Here the inert gas generating system continues to pressurize the accumulator. However, the nitrogen that is generated is directed specifically to chamber 1A. That is, isolation valves 3 are operated to isolate chamber 1A such that the chamber is filled with inert gas only and is devoid of any gaseous well returns. Chamber 1A will thus serve as a source of inert gas for purging operations. The gas from chambers 1B and 1C is injected downhole by means of flow controller 10. The gas may be injected by means of a drill string injection method, a concentric casing injection method or a combination of the two methods. As gaseous well returns are generated they pass through separator 12, are compressed by compressor 13 and then directed to chambers 1B and 1C of the accumulator. Chambers 1B and 1C therefore change from inert gas (nitrogen) storage to well gas (generally natural gas) storage or any combination of the injected gas (inert gas or reservoir gas) and well return gas (inert gas or reservoir gas). Backpressure valve 17 in the discharge line of the compressor diverts compressed well gas to the choke manifold as the pressure within chambers 1B and 1C approaches the maximum discharge pressure of the compressor.

It will thus be appreciated that by circulating well gas through chambers 1B and 1C, changes in the compressor output will not have any significant affect upon the injection rate into the standpipe. In addition, if the compressor fails, operations can be shut down through a "planned" procedure by utilizing the gas returns stored in chambers 1B and 1C. If necessary, gas can also be injected into the well at a very high rate through utilizing the stored return gas in chambers 1B and 1C and by increasing the injection rate through the operation of flow controller 10. Finally, since chambers 1B and 1C are effectively "open" to the separator or the compressor via the compressor or separator feedline, if the well is shut in at a point when connections in drilling pipe are being made a positive pressure will be maintained within the compressor feed or suction line to ensure that the compressor does not operate with an inlet pressure below the minimum design inlet pressure.

Figure 5:
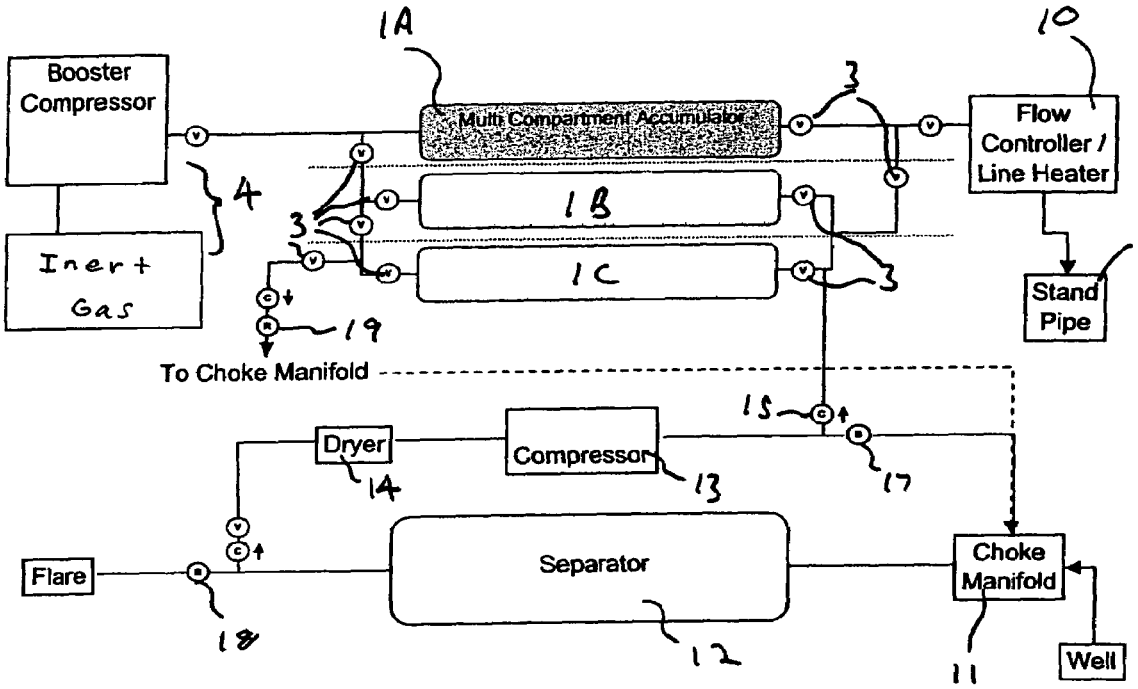

FIG. 5 shows in schematic form a fifth stage of an underbalanced drilling operation utilizing the present method. Here once again the inert gas generating system continues to pressurize chamber 1A of the accumulator. Chambers 1B and 1C are isolated by operation of isolation valves 3 to permit an inert gas or nitrogen purge of the well through allowing pressurized inert gas to flow from chamber 1A, through flow controller 10, and into the standpipe. The compressor will continue to recycle gas from the separator to accumulator chambers 1B and 1C with backpressure valve 17 diverting gas to the choke manifold as the pressure within the chambers 1B and 1C approaches the maximum discharge pressure of the compressor. Excess return gas will be sent to flare through the operation of pressure relief valve 18.

It will, of course, be understood by those of skill in the art that the above described illustrative example is but only one way of carrying out the present method. A wide variety of alterations could be made to various steps in the described procedure while remaining within the broad scope of the invention. For example, and as indicated previously, the inert gas generating system may take the form of a variety of commonly used systems or, alternatively, the accumulator may be pre-charged with individual chambers changed out with freshly filled chambers as required. In addition, for purposes of illustration accumulator 1 is depicted as being comprised of a three-chambered pressure vessel. The accumulator may be instead formed from two or more individual chambers. Further, if the accumulator volume is large enough to allow the well to be conditioned with the volume of gas available above standpipe pressure, operations can go directly to "steady state" operations after equipment start up and pressurization.

The described invention provides a method and a system for the circulation of gas when drilling or working a well. Under the method, utilizing a multi-chambered accumulator and a recycle loop allows for a reduced size inert gas generating system to be used in conjunction with a multi-chamber accumulator and with compression equipment to provide a system wherein drilling operations may be started with inert gas and switched to a well gas/inert gas mixture while drilling (depending on gas inflow rates) through circulating well gas through a portion of the multi-chamber accumulator. At the same time at least one chamber of the accumulator remains isolated from the well gas to maintain a readily available source of pressurized inert gas on location for purging operations. Once operational, in gas well applications (in particular) the system lends itself to gas recovery operations (via pipeline and/or compression equipment) since the well returns will be primarily natural gas when inflow is encountered. That is, during drilling operations inert gas only enters the system when purging thereby permitting natural gas to be recycled to a pipeline with minimal inert gas contamination. The reduction in the size of the inert gas generation system required under the present invention can also have a significant affect upon capital cost, as well as horsepower requirements and associated operating costs.

The employment of the present invention also presents a number of other significant advantages, some of which have been discussed in general above. For example, when involved in underbalanced drilling the combination of the flow controller and the multi-chambered accumulator presents the ability for high rates of gas (above and beyond that as typically available with conventional underbalanced drilling service gas equipment) to be injected into the well for short periods of time. The ability to substantially increase injection rates provides an enhanced safety feature that may be called upon when necessary, such as during instances where a drill pipe becomes stuck in the wellbore. The multi-chambered accumulator also permits the entire volume of the accumulator (down to the minimum inlet pressure of the compressor) to be injected into the standpipe via the compressor or separator feedline. Further, since the compressor output is primarily a function of its speed of operation and inlet pressure, presenting the ability to recycle gas to the multi-chamber accumulator and then controlling the flow of gas into the well by use of a flow controller helps to eliminate gas flow rate fluctuations within the standpipe that can occur if the compressor is allowed to inject gas directly into the well.

Through the use of high pressure storage and a flow controller the injection rate will remain essentially stable, even if the returns to the separator fluctuate. The described procedure slowly switches from the circulation of inert gas to well gas, which provides an additional advantage in terms of reduced rates of corrosion in sweet well applications. When the invention is used to start operations, if desired the well returns may be isolated from the accumulator, effectively by-passing the accumulator once stable, steady-state operations have been achieved. As also mentioned, the described method further provides a system whereby a compressor failure can be dealt with pursuant to a planned shut down procedure by utilizing volume from the accumulator, as opposed to immediately having to suspend operations.

The described method further presents the opportunity to reduce operational costs by increasing the effective rate of an inert gas generating system by capturing and storing inert gas that is generated during periods of time when inert gas is not required. Under traditional systems such gas would normally be vented to the atmosphere. For example, when drill pipe connections are being made the inert gas generating system can continue to operate and charge the accumulator avoiding the necessity to vent the excess gas.

It is to be understood that what has been described are the preferred embodiments of the invention and that it may be possible to make variations to these embodiments while staying within the broad scope of the invention. Some of these variations have been discussed while others will be readily apparent to those skilled in the art.

We claim:

1. A method for the circulation of gas when drilling or working a well, the method comprising:

(i) pressurizing at least two chambers of a multi-chambered accumulator with inert gas, said chambers of said multi-chambered accumulator operatively connected to one another and individually or in combination isolatable from each other;

(ii) isolating at least one chamber of said accumulator that has been pressurized with inert gas such that during drilling or working the well said isolated chamber remains pressurized with gas that has not been mixed with well gas returns;

(iii) extracting pressurized gas from one or more of the non-isolated chambers of said accumulator and injecting said pressurized gas into the well; and, (iv) collecting and compressing at least a portion of the gas returns from the well and delivering said pressurized returns to at least one of the non-isolated chambers of said multi-chamber accumulator.

2. The method as claimed in claim 1 including the step of using a flow controller to control the rate of injection of gas into the well.

3. The method as claimed in claim 1 wherein excess well gas returns are delivered to a gas export pipeline or gas recovery system.

4. The method as claimed in claim 1 including the steps of using a separator to separate liquid, solid and gas phases of the well returns and using said accumulator to maintain pressure upon said separator during start-up operations.

5. The method as claimed in claim 1 including the step of using said accumulator to maintain pressure on the compressor that is used to compress the gas returns.

6. The method as claimed in claim 1 wherein said gas is injected into the well by means of a drill string injection method, a concentric casing injection method or a combination of a drill string injection and a concentric casing injection method.

7. The method as claimed in claim 1 including the further step of using said inert gas in said isolated chamber of said accumulator for purging operations.

8. The method as claimed in claim 1 wherein at least one chamber of said multi-chambered accumulator is pressurized with inert gas from an on-site inert gas generating system.

9. The method as claimed in claim 1 wherein at least one chamber of said multi-chambered accumulator is pressurized with inert gas at a remote location and delivered to the well in a pressurized state.

10. The method as claimed in claim 1 wherein at least one chamber of said multi-chambered accumulator is pressurized with inert gas through the use of a mobile inert gas generator.

11. The method as claimed in claim 1 wherein said chambers of said multi-chambered accumulator are connected to one another by a piping system and individually or collectively isolatable from each other through the use of one or more valves.

12. A method for the circulation of gas when drilling or working a well, the method comprising:

(i) pressurizing at least two chambers of a multi-chambered accumulator with inert gas from an inert gas generating system, said chambers of said multi-chambered accumulator connected to one another by a piping system and individually or in combination isolatable from each other through the use of one or more valves;

(ii) operating said one or more valves to isolate one of the chambers of said accumulator that is pressurized with inert gas;

(iii) extracting pressurized inert gas from the non-isolated chambers of said accumulator and injecting said pressurized inert gas into the well;

(iv) collecting and compressing at least a portion of the gas returns from the well and delivering said pressurized returns to the non-isolated chambers of said multi-chamber accumulator such that thereafter gas injected into the well comprises gas returns from the well and the contents of the non-isolated chambers of said accumulator.

13. The method as claimed in claim 12 wherein excess gas returns from the well are vented, flared or exported to a gas recycling system or pipeline.

14. The method as claimed in claim 12 wherein the rate of injection of gas into the well is controlled through the use of a flow controller.

15. The method as claimed in claim 12 wherein gas is injected into the well by means of a drill string injection method, a concentric casing injection method or a combination of a drill string injection and a concentric casing injection method.

16. The method as claimed in claim 12 including the step of utilizing said inert gas in said isolated chamber of said accumulator for purging operations.

17. The method as claimed in claim 12 used when engaged in underbalanced drilling of the well.

18. The method as claimed in claim 12 including the steps of using a separator to separate liquid, solid and gas phases of the well returns and using said accumulator to maintain pressure upon said separator during start-up operations.

19. The method as claimed in claim 12 including the step of using said accumulator to maintain pressure on the compressor that is used to compress the gas returns.

20. A method for the circulation of gas in a well when drilling or working the well, the method comprising:

(i) pressurizing two or more chambers of a multi-chambered accumulator with inert gas from an inert gas system, said chambers of said multi-chambered accumulator operatively connected together and isolatable from one another either individually or in combination;

(ii) upon the pressurization of said two or more chambers with said inert gas, isolating at least one chamber from the others and extracting pressurized inert gas from the non-isolated chambers and injecting said extracted pressurized gas into the well;

(iii) controlling the rate of injection of gas into the well through the use of a flow controller; and, (iv) collecting and compressing at least a portion of the gas returns from the well and delivering said pressurized returns to said non-isolated chambers of said accumulator.

21. The method as claimed in claim 20 including the further step of injecting said inert gas from said isolated chamber into the well during purging operations.

22. The method as claimed in claim 20 used during the underbalanced drilling of a well.

23. The method as claimed in claim 20 including the steps of using a separator to separate liquid, solid and gas phases of the well returns and using said accumulator to maintain pressure upon said separator during start-up operations.

24. The method as claimed in claim 20 including the step of using said accumulator to maintain pressure on the compressor that is used to compress the gas returns.

25. The method as claimed in claim 20 including the step of isolating all of said chambers of said accumulator from said gas returns upon the establishment of stable, steady-state drilling conditions.

* * * * *